United States Patent [19]

Nicolas

[11] 4,435,227

[45] Mar. 6, 1984

[54] METHOD OF TREATING STEEL SURFACES TO PREVENT WEAR, AND COATING OBTAINED THEREBY

[76] Inventor: Guy R. Nicolas, 22 Clos Nollet, 91200 Athis-Mons, France

[21] Appl. No.: 428,661

[22] Filed: Sep. 30, 1982

[30] Foreign Application Priority Data

Oct. 6, 1981 [FR] France ..... 81 18780

[51] Int. Cl.[3] ..... C23C 11/04; C23F 7/24

[52] U.S. Cl. ..... 148/6.24; 148/6.35; 148/31.5; 428/627; 428/631; 428/621

[58] Field of Search ..... 148/6.24, 6.35, 31.5; 428/627, 639, 621

[56] References Cited

U.S. PATENT DOCUMENTS

| | | | |
|---|---|---|---|
| 2,243,787 | 5/1941 | Batchellar | 148/6.24 |
| 3,769,098 | 10/1973 | Kanetake | 148/6.24 |
| 3,987,222 | 10/1976 | Verkhouykh | 148/6.24 |

FOREIGN PATENT DOCUMENTS

| | | | |
|---|---|---|---|
| 7244416 | 11/1972 | Japan | 148/6.24 |

*Primary Examiner*—Sam Silverberg
*Attorney, Agent, or Firm*—Parkhurst & Oliff

[57] ABSTRACT

An object of the present invention is a method for the anti-wear treatment of the surface of steel parts having a carbon content of at least 0.15% and the coating obtained thereby. The method is characterized by the fact that an addition of sulfur, by depositing of a metal sulfide for example, and a vapor-phase chromizing are carried out in sucession on the surface to be treated.

The coating obtained is characterized by the presence of a layer of chromium sulfide on the surface and by the partial recrystallization of the underlying $M_7C_3$ chromium carbide layer.

The invention can be applied to any moving mechanical system which is subject to abrasion. The invention has importance because it increases the resistance to wear and the life of the system treated while limiting the wear of the untreated opposing part as a result of friction.

15 Claims, No Drawings

METHOD OF TREATING STEEL SURFACES TO PREVENT WEAR, AND COATING OBTAINED THEREBY

The field of art of the present invention involves the surface treatment of surface layers of steel parts in order to improve their mechanical properties. More particularly, the field of art of the present invention concerns treatments directed at increasing the resistance to wear of construction steel parts and tool steel parts which are subjected to a rubbing action.

The principal treatments of this type which are presently carried out on tool steels are nitriding, oxidation, chromizing, hard chroming and boriding. The direct sulfiding of a substrate has never been used for treatments of this type since sulfur leads to shortness of the steels. However, sulfur is used in combination with molybdenum or with iron in solid lubricants which are designed for anti-friction use but not for resistane to wear protection.

The known chromizing treatments produce coatings which have a good resistance to wear. These coatings generally consist of layers having a base of $M_{23}C_6$ and $M_7C_3$ chromium carbides. However, the layers are of limited thickness. For example, the layers obtained by chromization treatment of steels having a carbon content of at least 0.15% have a total thickness of carbides of about 10 to 15 $\mu$m.

In the following text M means the metals which are commonly infused in tool steels for example chromium (Cr), molybdenum (Mo), vanadium (V), nickel (Ni), manganise (Mn) etc; and the percents are always in mass.

The life of a system which has been treated in this manner and which is acted on by friction depends on the kinetics of wear of this layer of carbides. More precisely, the life of a treated system is dependent on the total thickness of the carbide layer and on the morphology of crystallization of the $M_7C_3$ carbides. With the known chromization treatments, $M_7C_3$ has a columnar structure, which is detrimental to good resistane to wear. Furthermore, in the case of contact by dry friction with materials of less hardness, the latter suffer very substantial wear.

An object of the present inveniton is to produce a surface coating on steel parts which improves the resistance to wear of parts subjected to frictional rubbing, thereby making it possible to increase the life of systems acted on by frictional rubbing while limiting the wear of the other substance which is in rubbing contact with the said parts.

An object of the present invention is a method of treating steel parts having a carbon content of greater than or equal to 0.15% so as to protect the parts against surface wear. The method is characterized by the fact that an addition of sulfur and a vapor phase chromizing are carried out in succession on the steel part surface.

By means of the preliminary application of sulfur to the base steel, the conditions of exchange between the chromium deposited during the subsequent chromization and the elements of the substrate are modified, thereby permitting the sulfur to combine with the chromium. The combination of sulfur and chromium produces an original surface layer comprised of chromium sulfide. A surface which has been treated in this manner has a satisfactory resistance to wear and has the additional advantage of greatly reducing the wear of the opposing body of uncoated steel. During the course of the rubbing, the sulfur reacts by contact with the opposing material and forms on the opposing material transfer layers which are rich in sulfided forms, thereby providing the opposing material with anti-wear protection. This treatment also makes it possible to increase the total thickness of the hard surface layer. It should be noted that the steel must have a carbon content greater than or equal to 0.15% to facilitate the formation of underlayers of carbides which help to create the resistance to wear.

The addition of sulfur is preferably achieved by depositing a metallic sulfide on the surface of the steel, such as by depositing a varnish having a base of molybdenum disulfide or by depositing an iron-molybdenum alloy sulfide of the formula $(Fe\text{-}Mo)_3S_4$.

Direct sulfiding of the substrate is to be avoided since the sulfur leads to shortness of the steels. Furthermore, it is possible to assure the transport of the chromium from a chromium halide in vapor phase by means of an exchange reaction with the metallic elements.

A deposit of iron-molybdenum is preferably achieved prior to the depositing of the iron-molybdenum sulfide. If the iron-molybdenum sulfide deposit is applied directly to the steel part surface its adherence over time becomes rather weak. In contrast, a prior iron-molybdenum deposit substantially increases the adherence of the subsequent iron-molybdenum sulfide deposit.

The chromizing is performed at 950° C. for 15 hours, without the flow of hydrogen. In fact, hydrogen may desulfurize the deposit by formation of $H_2S$ and thus prevent the formation of chromium sulfide on the surface of the substrate.

The customary heat treatments can be applied to steels treated by this process. However, water quenching is not recommended since it may introduce cracks into the coating produced by the invention.

A further object of the invention is a surface coating for the prevention of the wear of steel parts which have a carbon content greater than or equal to 0.15%, said coating characterized by the fact that it is formed of a surface layer of chromium sulfide, and further comprising an inner layer underlying the surface layer and consisting essentially of chromium carbides $M_{23}C_6$ and $M_7C_3$.

The coating obtained by the process of the invention is characterized by the fact that it is comprised of a surface layer of chromium-molybdenum sulfide, the molybdenum being substituted in the hexagonal chromium-sulfide lattice in the amount of a content by weight of less than 18%.

The coating further comprises a layer directly beneath the surface layer comprising the chromium carbides $M_{23}C_6$ and $M_7C_3$.

The layer of carbide of carbide is composed of two sublayers formed in succession and consisting of chromium carbide $M_{23}C_6$ and chromium carbide $M_7C_3$, respectively.

The sublayer of chromium carbide $M_7C_3$ is recrystallized over a part of its thickness from the substrate. In fact, there is a noted modification of the manner of crystallization of the $M_7C_3$ carbides. The molybdenum codiffuses with the chromium into the $M_7C_3$ carbide, thus making it possible to reduce the amount of chromium in this phase and to reach the critical content of 60% chromium at which the recrystallization of $M_7C_3$ takes place. The $M_7C_3$ carbide increases the tenacity of the layer of carbide and therefore its resistance to wear.

Other advantages and features of the invention will become evident from the following non-limiting description of one embodiment of the invention.

The steel used for this description is the low-alloy 35 CD 4 steel which is widely used in industrial manufacture. However, any other steel with a carbon content of at least 0.15% could be employed.

The invention comprises a two-part sequential treatment, the order of which must be respected. The first part of this treatment consists of a process which makes it possible to effect a deposit of sulfide of the iron-molybdenum or molybdenum sulfide type on the surface of the steel. The manner of treatment is of no importance except for the necessity that the deposit by homogenous in thickness and distribution. Deposits of the varnish type having a base of molybdenum disulfide may be used, or deposits by the "sputtering magnetron" technique $(Fe\text{-}Mo)_3S_4$ may be used. This latter technique allows for good control over the thickness and distribution of the initial deposit.

A deposit of at least 5 μm is necessary in order to obtain good results. A thickness of 8 to 15 μm is preferable for the subsequent conditions of the chromizing process.

When the steel parts are treated without the prior deposit of iron-molybdenum, deposit cracks before chromizing are observed. Treatments with prior deposit of iron-molybdenum have therefore been carried out, and did not demonstrate any lack of adherence.

After depositing the layer of sulfide, the chromizing treatment is carried out in accordance with average parameters such as:

| Cement | |
|---|---|
| Ferrochromium powders | 60–40 |
| Anti-inserting agent | $Al_2O_3$ |
| Carrier | $NH_4Cl$ |
| Rate of rise at the isotherm | 150° C. per hour |
| Thermal arrest | 950° C. |
| Duration of thermal arrest | 15 hours |

In order to avoid the surface formation of a sulfurfree layer of chromium, it is necessary to eliminate the flow of hydrogen which is customarily provided in these types of treatments.

It should be noted that the type of cement and the static or dynamic manner of transport do not determine the nature of the coating, they merely modulate the relative layer thicknesses of the coating.

Two main layers of equal thickness having respectively a base of chromium sulfide and chromium carbides, comprise the coating obtained after chromizing.

The outer layer, consisting of the phase (Cr, Mo)S which crystallizes in the hexagonal system, is rather heterogenous with respect to its distribution in molybdenum and sulfur. Iron is present therein in practically 0% content and Mo at the rate of at most 18%.

The subjacent adjoining layer is distributed into two sublayers of carbides $M_{23}C_6$ and $M_7C_3$. This latter carbide, which is rich in molybdenum, is partially recrystallized.

During the exchanges, the iron is pumped from the initial deposit of iron-molybdenum-sulfur to give rise to a chromium deposit. The chromium diffuses through the entire initial deposit, and migrates up to the interface with the substrate in order to interact with the carbon of the steel and form the sequence of carbides obtained in conventional chromizing. However, in this case the carbides formed have a few different features. Specifically, the $M_{23}C_6$ carbide sublayer is much larger and the $M_7C_3$ carbide is partially recrystallized.

On the surface, the general morphology of the layers is in the form of crystals of spherular front. These crystals are distributed in domains separated by rather shallow "channels".

In cross section, the coating is distributed into two main layers, A and B, both of which have thicknesses of 9 μm.

Layer A has a biphase appearance with domains of basaltic character. These domains are in general recessed with respect to the outer surface, and correspond to channels.

Layer B is composed of two sublayers $B_1$ and $B_2$. Disclosed after basic attack, these sublayers correspond to the carbides $M_{23}C_6$ and $M_7C_3$, respectively. Sublayer $B_2$ has the typical morphology of the $M_7C_3$ carbide, with recrystallization present.

Layer A consists essentially of the elements chromium, sulfur and molybdenum. The two-phase appearance observed in metallography seems to be due only to relative variations of sulfur and molybdenum. The iron content is almost 0% and molybdenum is present in amounts of at most 18%.

On the basis of data seen in the binary chromium-sulfur diagram, it appears from the level of concentration of the chromium in this layer that the phase of which it is comprised is chromium sulfide CrS. This phase crystallizes in the hexagonal system (a=3.45Å, C=5.76Å, c/a=1.67).

Layer B is comprised of two layers consisting of carbides in which no sulfur is detected. The levels of chromium concentration and the shape of the carbon distribution profiles indicate that the sublayers $B_1$ and $B_2$ correspond to the carbides $M_{23}C_6$ and $M_7C_3$ respectively. It should be pointed out that the molybdenum content in these carbides is high. However, the molybdenum may be replaced extensively in this type of phase.

Contrary to the results obtained in previous analysis, it is noted here that the molybdenum, instead of being pumped in the stubstrate to migrate towards the carbides which are being formed, has in fact diffused up into the substrate from the initial deposit.

In cross section, the coating is distributed in two main sublayers of a thickness of 9 μm each, namely total thickness of 18 μm.

The surface layer, whose biphase appearance is due only to relative variations in molybdenum, is comprised of the phase (Cr, Mo)S. The hardness of this phase is $770\pm50$ $Hv_{0.02}$.

The second layer, disclosed by metallographic attack in basic medium, is comprised of chromium carbides enriched in molybdenum $M_{23}C_6$ and $M_7C_3$. The carbide $M_7C_3$ is in this case partially recrystallized, which assures an increase in tenacity for this layer of carbide. The hardness of the carbide $M_{23}C_6$ is $1400\pm200$ $Hv_{0.02}$, and that of the carbide $M_7C_3$ is $2700\pm500$ $Hv_{0.02}$ for the recrystallized domain.

It should be noted that upon direct chromizing with identical treatment parameters, the layer had a total carbide thickness of 13 μm.

A tribological characterization of this layer was effected. In a standard wear test on a tribuometer in pin-disk configuration, the test parameters were as follows:

flat disk of 35 CD 4 steel cylindrical pins with flat end of a diameter of 1.5 mm of 35 CD 4 steel, heat-treated for a hardness of 310 $Hv_{0.5}$, normal stress 1N; namely a normal static stress of 0.56 MPa, circumferential speed: 500 rpm linear speed of contact: 41 meters per minute laboratory temperature: 20° C.

dry friction stressing distance: 50 km.

Indentical tests were carried out on 35 CD 4 disks chromized directly using the same treatment parameters, the results of Table 1 show that:

(a) the layer comprised of chromium sulfide is less worn that the layer obtained by direct chromizing; and (b) the opposing pin, which has no specific anti-wear treatment, is only very slightly damaged. The particularly slight wear has been assured by a transfer film from the sulfochromization treated disks. the transfer film having a base of sulfur, oxygen and carbon shown by Auger spectrometry.

TABLE 1

| | | Average wear in cubic millimeters per 10 kilometers | | |
|---|---|---|---|---|
| Treatment | Type of layer | disk | pin | cumulative |
| Direct chromization | $M_{23}C_6/M_7C_3$ | 1.20 | 1.80 | 3.00 |
| Sulfo-chromization | (Cr, Mo)S $M_{23}C_6/M_7C_3$ | 0.96 | 0.29 | 1.25 |

The importance of the present invention resides in the fact that it is possible to increase the overall performance of resistance to wear of systems stressed by dry friction or which are poorly lubricated. Furthermore, this gain in quality can be acquired on the basis of different techniques of use without thereby fundamentally modifying the characteristics obtained. A change in the technology of the carrying out of the conventional chromizing treatment requires only an adjustment of the parameters, which is of obvious interest from an economic standpoint.

The economic interest resides, furthermore, in the improvement in the life and reliability of the parts.

The invention can be applied to any moving mechanical system made of steel, in particular the mechanisms of weapons or transmission mechanisms, motors, and the like.

What is claimed is:

1. A method for treating steel parts having a carbon content of at least 0.15%, said treatment providing said steel parts with protection against surface wear, comprising:

a three-stage process comprising, a first stage wherein iron-molybdenum is deposited on the surface of the steel, a second stage wherein a sulfur containing compound is introduced to the surface of said steel part and thereafter adheres to said surface; and a third stage wherein said steel part with said sulfur containing compound adhering thereto is subjected to vapor phase chromizing thereby forming an outer surface layer comprising chromium-molybdenum sulfide and an inner layer under lying the outer surface layer comprising chromium carbides $M_{23}C_6$ and $M_7C_3$.

2. A method for producing a surface coating for protecting steel parts having a carbon content of at least 0.15% from surface wear, comprising:

depositing iron-molybdenum on the surface of said steel part followed by the addition of sulfur to the surface of said steelpart followed by vapor phase chromizing.

3. The method of claim 1, wherein the addition of sulfur is effected by depositing a metal sulfide on the surface of the steel.

4. The method of claim 3, wherein a varnish having a base of molybdenum disulfide is deposited on the surface of the steel.

5. The method of claim 3, comprising depositing a sulfide of an iron-molybdenum alloy having the formula $(Fe\text{-}Mo)_3S_4$ on the surface of the steel.

6. The method of claim 1, wherein a first layer of iron-molybdenum or at least 1 μm in thickness is deposited, followed by a second layer consisting essentially of iron-molybdenum of at least 4 μm in thickness.

7. The method of claims 1 or 2, wherein the chromizing is effected at 950° C. for 15 hours without flow of hydrogen.

8. The method of claim 6, wherein the chromizing is effected at 950° C. for 15 hours without flow of hydrogen.

9. The method of claim 1 or 2, additionally comprising a thermal hardening-tempering treatment without water quenching.

10. The method of claim 8, additionally comprising a thermal hardening-tempring treatment without water quenching.

11. An anti-wear surface coating for steel parts having a carbon content of at least 0.15%, comprising:

a steel member with an outer surface layer comprising chromium molybdenum sulfide, and further comprising an inner layer underlying the surface layer and including chromium carbide $M_{23}C_6$ and $M_7C_3$.

12. The surface coating of claim 11, wherein said coating comprises a surface layer of chromium-molybdenum sulfide, the molybdenum being substituted in a hexagonal lattice of the chromium sulfide in an amount by weight of at most to 18%.

13. The surface coating of claim 11, wherein said layer of carbides comprises two sublayers formed in succession by chromium carbide $M_{23}C_6$ and chromium carbide $M_7C_3$, respectively.

14. The surface coating of claim 13, wherein said chromium carbide $M_7C_3$ sublayer is recrystallized over a portion of its thickness, starting from the substrate.

15. The surface coating of claim 11, wherein said coating comprises a metal sulfide layer and a metal carbide layer, each of a thickness of at least 9 μm, and a total thickness for both said layers of at least 18 μm.

* * * * *